United States Patent [19]

Bobb et al.

[11] 4,332,431

[45] Jun. 1, 1982

[54] PREASSEMBLED ELECTRICAL CONNECTOR

[75] Inventors: Clifford F. Bobb, Carlisle; Robert F. Cobaugh, Elizabethtown, both of Pa.

[73] Assignee: AMP Incorporated, Harrisburg, Pa.

[21] Appl. No.: 267,098

[22] Filed: May 26, 1981

Related U.S. Application Data

[63] Continuation of Ser. No. 105,046, Dec. 18, 1979, abandoned.

[51] Int. Cl.[3] ..... H01R 13/62

[52] U.S. Cl. ..... 339/74 R; 339/176 MP

[58] Field of Search ..... 339/74 R, 75 R, 75 M, 339/75 MP, 176 MP

[56] References Cited

U.S. PATENT DOCUMENTS

| | | | |
|---|---|---|---|
| 3,710,303 | 1/1973 | Gallager | 339/17 L X |
| 3,896,535 | 7/1975 | Tucci | 29/206 |
| 4,083,101 | 4/1978 | Coller | 29/739 |
| 4,133,592 | 1/1979 | Cobaugh et al. | 339/17 M |

*Primary Examiner*—Joseph H. McGlynn
*Assistant Examiner*—Frank H. McKenzie, Jr.
*Attorney, Agent, or Firm*—Gerald K. Kita

[57] ABSTRACT

A zero insertion force (ZIF) connector is preassembled with electrical terminals in a dielectric housing. The housing is molded with integral features that facilitate snap on assembly of a camming mechanism for the terminals. A multiblade insertion tool enters the housing to register with the contacts and to drive the terminals into apertures of a circuit board.

12 Claims, 11 Drawing Figures

80
82
84
84
1
68
68
4
4
30
30
46
28
62A
62
62B
4A
64
66
50
66
2
2
50
12
12
74
44
44
74
16
16
42
42
76
76
78
78
40
40
88
20
20
86
86
22
22

PREASSEMBLED ELECTRICAL CONNECTOR

This is a continuation of application Ser. No. 105,046, filed Dec. 18, 1979, now abandoned.

FIELD OF THE INVENTION

The invention relates to a preassembled zero insertion force (ZIF) electrical circuit board connector in which electrical terminals are to be driven into apertures of a circuit board with a compression fit.

BACKGROUND OF THE PRIOR ART

A circuit board connector typically comprises an elongated, rigid dielectric housing containing one or more rows of leaf spring electrical terminals. A card edge type connector is adapted with a receptacle opening into which may be plugged a circuit card having conductive circuits thereon for frictional and electrical engagement by the leaf spring terminals. A stackable connector is adapted to receive conductive electrical post terminals of another circuit board connector into the receptacle opening for frictional and electrical engagement by the leaf spring terminals. Either type of circuit board connector may be a ZIF type wherein the housing is provided with a camming mechanism which resiliently deflects the leaf spring terminals away from the receptacle opening, to allow entry of the circuit card or conductive terminals without undue frictional engagement by the leaf spring terminals. The camming mechanism releases the leaf spring terminals so that they resiliently spring into frictional engagement with the card or the post terminals.

A ZIF connector is mounted on a circuit board by its leaf spring terminals, which extend below the connector housing and which are driven into apertures of the circuit board with a compression fit. Some circuit board mounted connectors are sufficiently rugged to withstand forceful driving of the terminals into circuit board apertures, even with the connector housing preassembled over the terminals. However, the trend toward miniaturization in electronic circuits has necessitated connectors which are not adaptable for preassembly, prior to driving the terminals in a circuit board. Miniaturized connectors are less rugged and are provided with thinner, more densely spaced terminals. A larger number of terminals is allowed by dense spacing, with larger forces needed to drive the terminals into a circuit board. The densely spaced, fragile terminals are susceptible to damage by slightly misaligned insertion tooling. If the terminals are preassembled in a connector housing, the presence of the housing provides a further impediment to alignment of the insertion tooling. Replacing a terminal damaged by the insertion procedure is further impeded by presence of the housing. Accordingly, the accepted assembly procedure has heretofore required insertion of the terminals while they remained separate from the housing and still connected to a carrier strip. One example of a machine for inserting the terminals is disclosed in U.S. Pat. No. 3,875,636. Following insertion of the terminals, the carrier strip was removed and the connector housing then was carefully assembled onto the terminals. An example of such a housing is disclosed in U.S. Pat. No. 3,905,665. The housing has an open bottom allowing the housing to pass freely over the inserted terminals. A latching finger is molded to the housing which latches to one of the terminals, thereby retaining the housing in place.

SUMMARY OF THE INVENTION

The present invention relates to an improved circuit board connector of the stacking type, which also may be modified to serve as a card edge type. The terminals of the connector are preassembled in the connector housing. Each terminal is designed with a tool rest. An insertion tool is provided with multiple blades which may enter the housing to engage the tool rests of the terminals and collectively drive the terminals into a circuit board.

Additionally, the connector comprises a ZIF type, which may be preassembled without special tools. The camming mechanism of the connector is readily disassembled for replacement of a damaged terminal, or for other repairs. In a specific form of the connector, a shroud portion of the mechanism is pivotally mounted on fulcrum tabs molded integrally with the housing. Resilient fingers, also integrally molded, bias the shroud into pivotal engagement with the fulcrum tabs. Also, the leaf spring terminals of the connector coact with the resilient fingers to bias the shroud into engagement with the fulcrum tabs. The resilient fingers are deflected to allow snap on, snap off mounting of the shroud.

OBJECTS

An object of the present invention is to provide a circuit board connector adapted for assembly of all component parts prior to precisely aligning insertion tooling with the terminals of the connector and driving the terminals collectively into respective apertures of a circuit board with a compression fit.

Another object of the present invention is to provide a circuit board connector having a housing, leaf spring terminals and a camming mechanism for the terminals, all of which are preassembled prior to driving the terminals collectively into respective apertures of a circuit board with a compression fit.

Another object is to provide a circuit board connector with an assembly of a housing and leaf spring terminal which are formed with tool rests to be engaged by insertion tool blades which may enter the housing, register precisely with the terminals and drive the terminal collectively into respective circuit board apertures with a compression fit.

Another object is to provide a ZIF connector with terminals preassembled in a housing molded with integral fulcrum tabs and integral fingers, which resiliently bias a snap on, snap off shroud portion of a terminal biasing cam mechanism into pivotal connection with the fulcrum tabs.

Another object is to provide a ZIF connector with preassembled terminals, housing and a cam mechanism of which a snap on, snap off shroud portion is resiliently biased into pivotal mounting on the housing by resiliency inherent in the terminals, coacting with resilient fingers molded integrally with the housing.

Other objects and advantages of the present invention will become apparent from the following detailed description taken in conjunction with the accompanyng drawings.

DRAWINGS

FIG. 1 of the drawings is an enlarged fragmentary perspective of a ZIF type circuit board connector comprising a preferred embodiment of the present invention.

DETAILED DESCRIPTION

Figures 1, 1A:
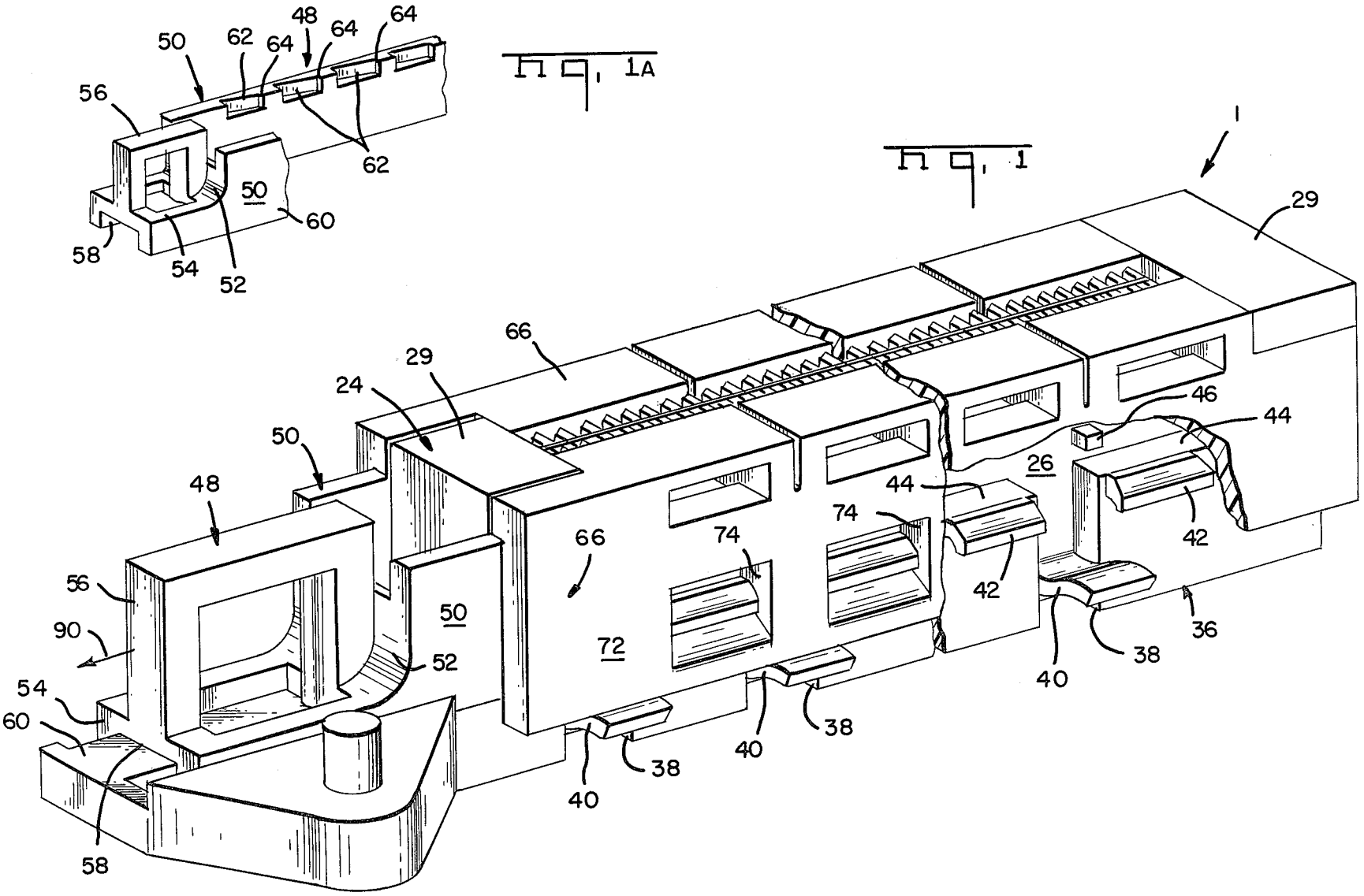
FIG. 1A is a reduced fragmentary perspective of a cam of the connector illustrated in FIG. 1.
Figure 6:
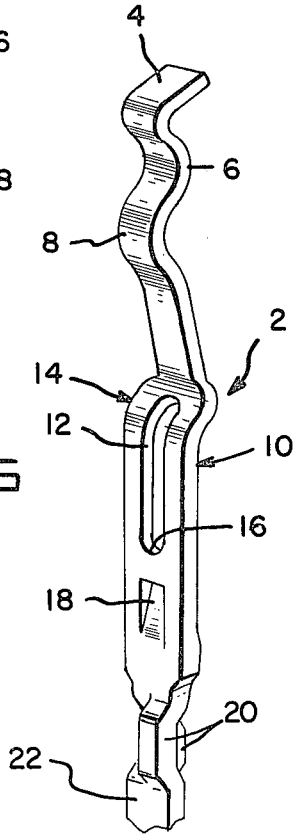
FIG. 6 is an enlarged perspective of a terminal according to the present invention.

With more particular reference to FIG. 1 of the drawings, a stackable, ZIF type, circuit board connector is generally shown at 1. FIG. 6 shows an electrical terminal 2 for use in the connector 1, stamped and formed from metal stock into a leaf spring configuration. An upper free end 4 is formed with a reversely curved shape, defining a curved recess portion 6 adjacent a curved projecting portion 8, which is the engaging electrical contact portion of the terminal. A substantial lengthy section of the terminal 2 is widened as shown at 10. A vertical slot 12 is provided along the widened section 10, particularly along an arcuate part 14 of the section 10. The lower end of the slot is defined by a rounded, end wall 16, providing a tool rest, for a purpose to be described. Below the slot 12, yet in the widened section 10 of the terminal, a spur or lance 18 is formed, by punching the outline of three sides of the lance, and then bending the outlined lance to project the same out of the thickness plane of the terminal. Below the widened section 10, the terminal has a split section formed into a pair of offset legs 20 which are adapted for frictional, wedged retention in an aperture of a circuit board. The upper end of the terminal is adapted for mounting in the connector 1. A lower end 22 of the terminal 2 is adapted to project outwardly from a circuit board in which the legs 22 are mounted, and to provide a circuit path conductor, which can be pluggably inserted into another stackable, ZIF type, circuit board connector 1, and be electrically engaged by a corresponding terminal of that connector.

Details of the connector 1 will be described with reference with FIGS. 1, 1A, 5 and 5A. A housing portion generally indicated at 24 is of unitary, molded plastic construction, and includes a pair of parallel, horizontally elongated side walls 26, and a central barrier wall 28 parallel with the walls 26. The barrier wall is molded at each end with an end wall 29. In the stackable version of the ZIF connector, receptacle openings are in the form of a row of vertical cavities 30 molded along each side of the barrier wall 28, with adjacent cavities 30 being separated by molded, vertical webs 32 bridging between, and integrally joining, the wall 28 with an outer wall 26.

Figure 5A:
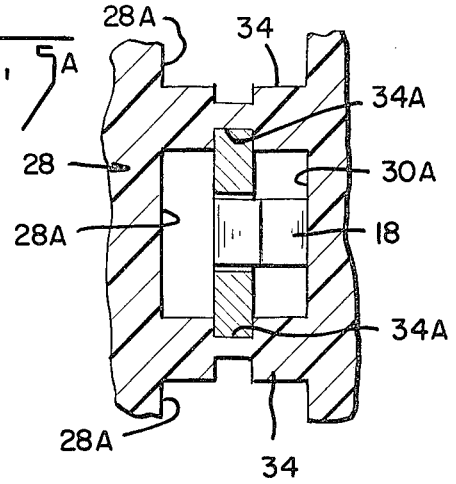
FIG. 5A is an enlarged fragmentary section taken along the line 5A of FIG. 5.
Figure 5:
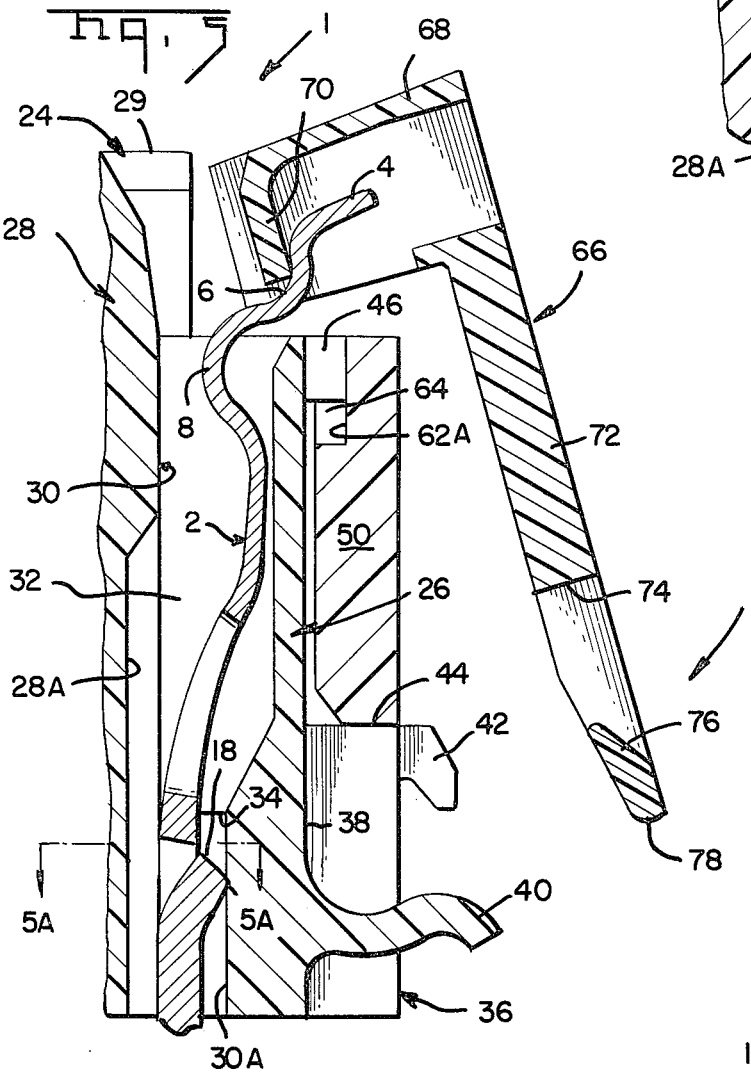
FIG. 5 is a fragmentary enlarged transverse section similar to FIG. 2 illustrating assembly of a snap on, snap off shroud portion of the connector.

As shown in FIGS. 5 and 5A, each web 32 has a lower, thickened web portion 34. Vertical slots 34A are recessed in the web portions 34. Each cavity 30 has a smaller sized cavity portion 30A passing between adjacent thickened web portions 34. The barrier wall 28 is provided with a vertical slot 28A communicating with each cavity portion 30A.

As shown in FIGS. 1 and 5, along the bottom length of each side wall 26, is molded a thickened wall portion 36 provided with a series of vertical slots 38. A series of thin, and thereby stiffly resilient, fingers 40 are molded to project outwardly from the slots 38, and outwardly past the thickened wall portion 36. Each finger cups upwardly with a smoothly curved, S-shape. Also projecting outwardly past the wall portion 36 is a series of fulcrum tabs 42 of inverted hook configurations, molded integrally with the wall portion 36. A horizontal shelf 44 is provided along the top of each wall portion 36. Along the top length of each side wall 26 is molded a series of wedge shaped projections 46, spaced above a corresponding shelf 44.

With reference to FIGS. 5, 5A and 6, assembly of the terminal 2 into the connector 1 will be described. A terminal 2 is inserted vertically downward along each corresponding cavity 30. As shown in FIG. 5A, the widened section 10 of the terminal slidably interfits within corresponding slots 34A in the webs 34. The lance 18 of the terminal wedges against the wall defining the cavity portion 30A. Thereby, the terminal is locked into a position of stable support. The cavity portion 30A comprises a terminal receiving cavity portion which opens vertically upward into the remainder of cavity 30 which defines a receptacle opening of the connector 1 into which the contact section 8 of the terminal 2 projects. The free end 4 of the terminal projects vertically upward beyond the sidewall 26.

With more particular reference to FIGS. 1, 1A and 5, a molded unitary cam, generally shown at 48, includes a pair of parallel, elongated cam blades 50 integrally joined by a vertical end wall 52 which, in turn, is joined to a horizontal platform portion 54. A handle 56 is molded to join the wall 52 and the platform 54. The platform 54 is provided with an inverted track 58 which, as shown in FIG. 1, is slidably assembled along an elongated rail 60 molded integral with, and projecting from, one end wall 29 of the housing 24. Each blade 50, as shown in FIG. 1A, is provided with a series of wedge shaped sections 62 horizontally, one behind the other. Each wedged shaped section 62 terminates in a projecting, vertical stop wall 64. The cam 48 is assembled to the housing 24 as shown in FIG. 1A with the track 58 slidably assembled over the rail 60, and with the cam blades 50 slidably received and seated against the horizontal shelves 44. The inclined surface of each wedged shaped section 62 slideably registers against a corresponding projection 46 on each housing side wall 26.

As shown in FIGS. 1 and 5, a molded dielectric shroud 66 is assembled to the housing 24, covering each cam blade 50. Each shroud is molded with a top wall 68 which is offset with a vertical portion at 70, hooked over the projecting free ends 4 of a row of terminals 2, and registered within the recess portions 6 of the terminals. The shroud further is molded with an elongated side wall 72 that is provided with a series of apertures 74 defining tapered horizontal lip portions 76 at the lower peripheries of said apertures. The shroud is hooked over the terminal ends 4 in registration with the recess portions 6, and then pivoted toward the wall 36 of the housing 24. The bottom edge 78 of the shroud will engage and resiliently deflect the free ends of corresponding fingers 40 resiliently downward vertically, allowing the apertures 74 to align with and snap over the fulcrum tabs 42. The contact ends 4 also are deflected slightly to allow the fulcrum tabs 42 to align with the apertures 74. The stored resilient energy in each of the spring contacts continuously tends to lift the shroud 66, hooking the tapered lip portions 76 under the fulcrum tabs 42. Such lifting action coacts with the lifting action of the series of fingers 40 which continuously, resiliently impinge against a bottom edge 78 of the shroud. The shroud is readily disassembled by prying the edge 78 until it snaps outwardly from the fulcrum tabs and the fingers, and then removing the shroud from the assembly. The terminals 2 are exposed for selective removal by any suitable tool with a fishhook shaped blade, not shown, hooked into the recess 12 of a selected terminal and pulled to remove the terminal.

Figure 2:
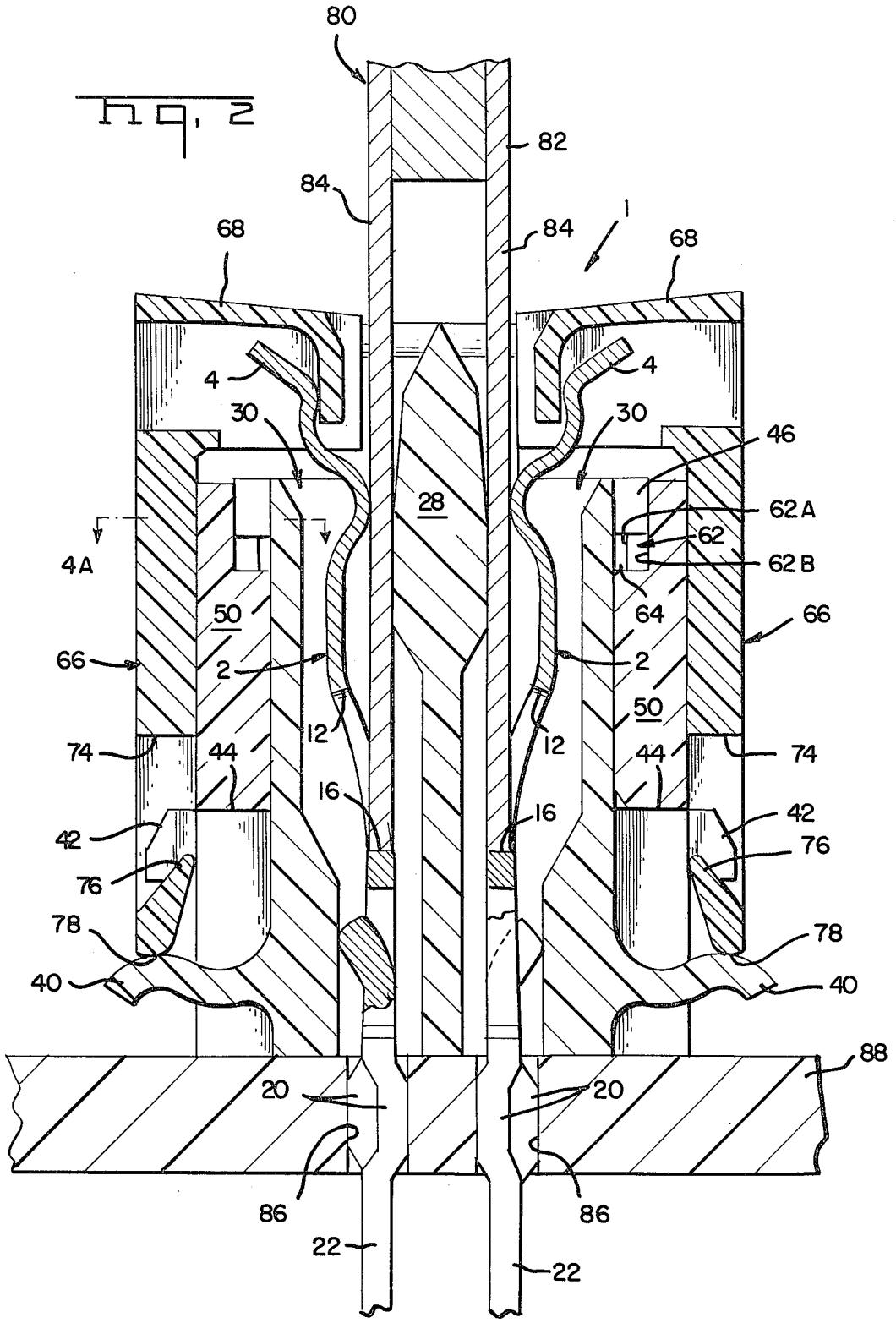
FIG. 2 is an enlarged fragmentary transverse section of the elongated connector illustrated in FIG. 1, and illustrating more particularly a multiple blade insertion tool for collectively driving the electrical terminals of the connector into respective apertures of a circuit board.

FIG. 2 illustrates the completed assembly of the connector 1. Additionally, the connector is illustrated with an insertion tool 80 in the form of an elongated, rectangular in section, anvil block 82 provided with rows of depending insertion blades 84 corresponding to the number of terminals 2 in the housing 24. Each insertion blade 84 is of a size to be inserted freely into a corresponding receptacle opening 30. Each blade passes between a contact 2 and the central barrier wall 28. The tip or end of each blade enters a corresponding terminal aperture 12 and seats against a tool rest 16 of each terminal. The tips are complimentary in shape to the rounded configuration of the tool rests 16. A downward force applied to the anvil causes each blade to press each of the terminals vertically downward to insert and wedgingly register the terminal legs 20 frictionally within the apertures 86. Considerable force is required to drive all the terminals into the circuit board apertures. The forces are applied directly to the terminals only, leaving the remaining components of the connector 1 free from possible damage. The insertion blades 84 also are supported against the central barrier 28 to prevent their buckling. The terminals 2 resiliently press against the blades 84 supporting the blades against the wall 28. Each blade 84 is independently adjustable by slight deflection to align in the cavity and seat properly with a corresponding terminal tool rest.

Figure 4:
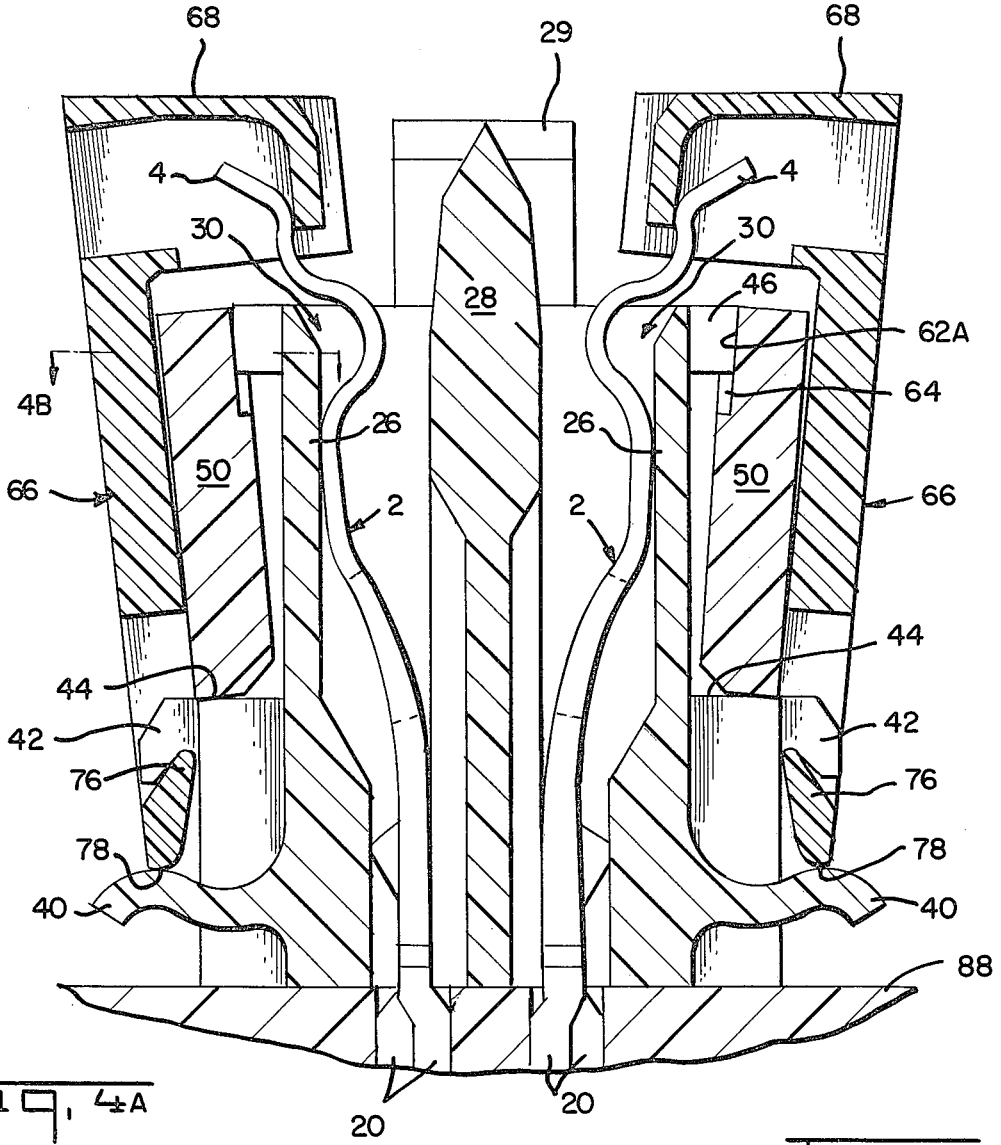
FIG. 4 is a section similar to FIG. 2 illustrating a terminal camming feature of the connector illustrated in FIG. 2.

FIG. 4 illustrates the camming action of the connector 1. The cam 48 is slid along the rail 60 in the direction of the arrow 90 in FIG. 1, causing the cam blades 50 to slidably traverse over the walls 44. The relatively thick portions 62A of the wedge sections 62 will overlie the projections 46, wedging apart the shrouds 66 from the housing walls 26. To prevent inadvertent removal of the cam blades, the walls 64 register against the projections 46 to limit sliding displacement of the cam blades 50. The shrouds 66 will pivot about the fulcrum tabs 42. Since the shrouds are hooked over the terminal ends 4, pivoting the shrouds will tend to deflect the terminals toward one side of each corresponding receptacle opening 30. In this manner, circuit path conductors may be readily inserted into the corresponding receptacle opening 30 without undue frictional engagement against the terminals 2.

Figure 3:
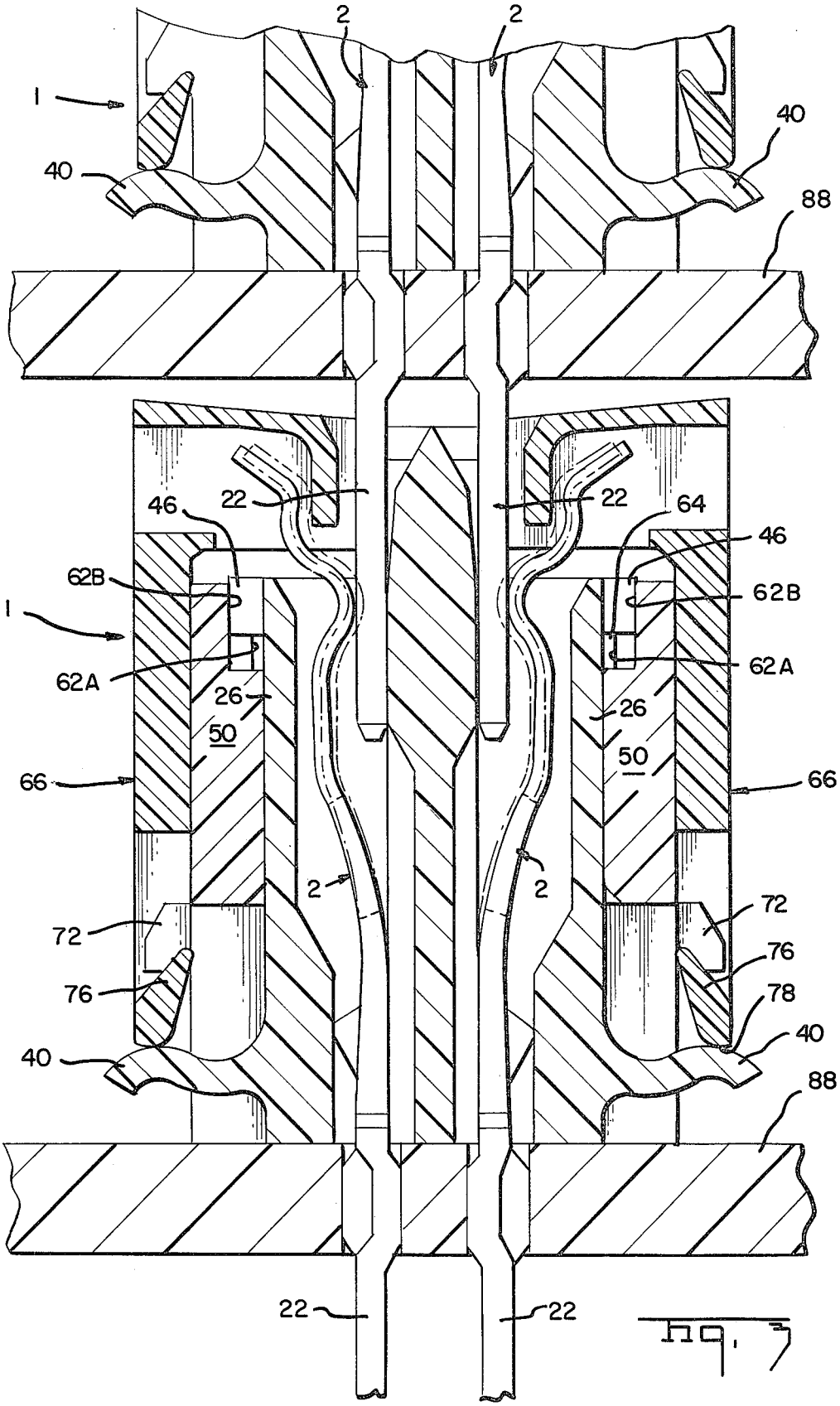
FIG. 3 is an enlarged section similar to FIG. 2 illustrating two electrical connectors of the preferred embodiment in stacked relationship, with the terminals of an upper connector inserted into the lower connector and frictionally engaged by the terminals of the lower connector.
Figure 4A:
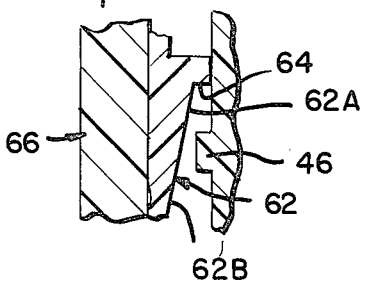
FIG. 4A is a fragmentary enlarged section taken generally along the line 4A of FIG. 2.
Figure 4B:
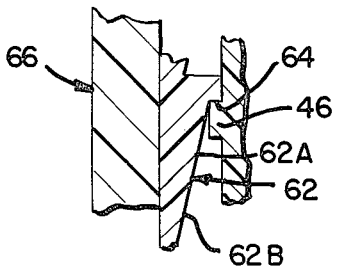
FIG. 4B is a fragmentary enlarged section similar to FIG. 4A, and taken generally along the line 4B of FIG. 4.

FIG. 3 shows a pair of connectors 1 of the type described. The circuit path conductors, inserted into the receptacle openings 30 of the lower illustrated connector, are portions 22 of the terminals 2 of the other connector 1. Therefore, the connector 1 described is a stacking ZIF type circuit board connector. The terminals 2 of the lower connector 1 frictionally engage the terminal portions 22 of the upper connector 1. This is accomplished by slidably displacing the cam blades 50 until the relatively thinner dimension 62B, of the wedge sections 62 are impinged against the series of projections 46. When this occurs, the cam blades 56 will register against the walls 26, allowing the terminals 2 to deflect by their stored spring energy into engagement with the inserted circuit path conductor portions 22. Such deflection of the terminals also will pivot the shrouds to their positions shown in FIGS. 3 and 4A.

Figure 7:
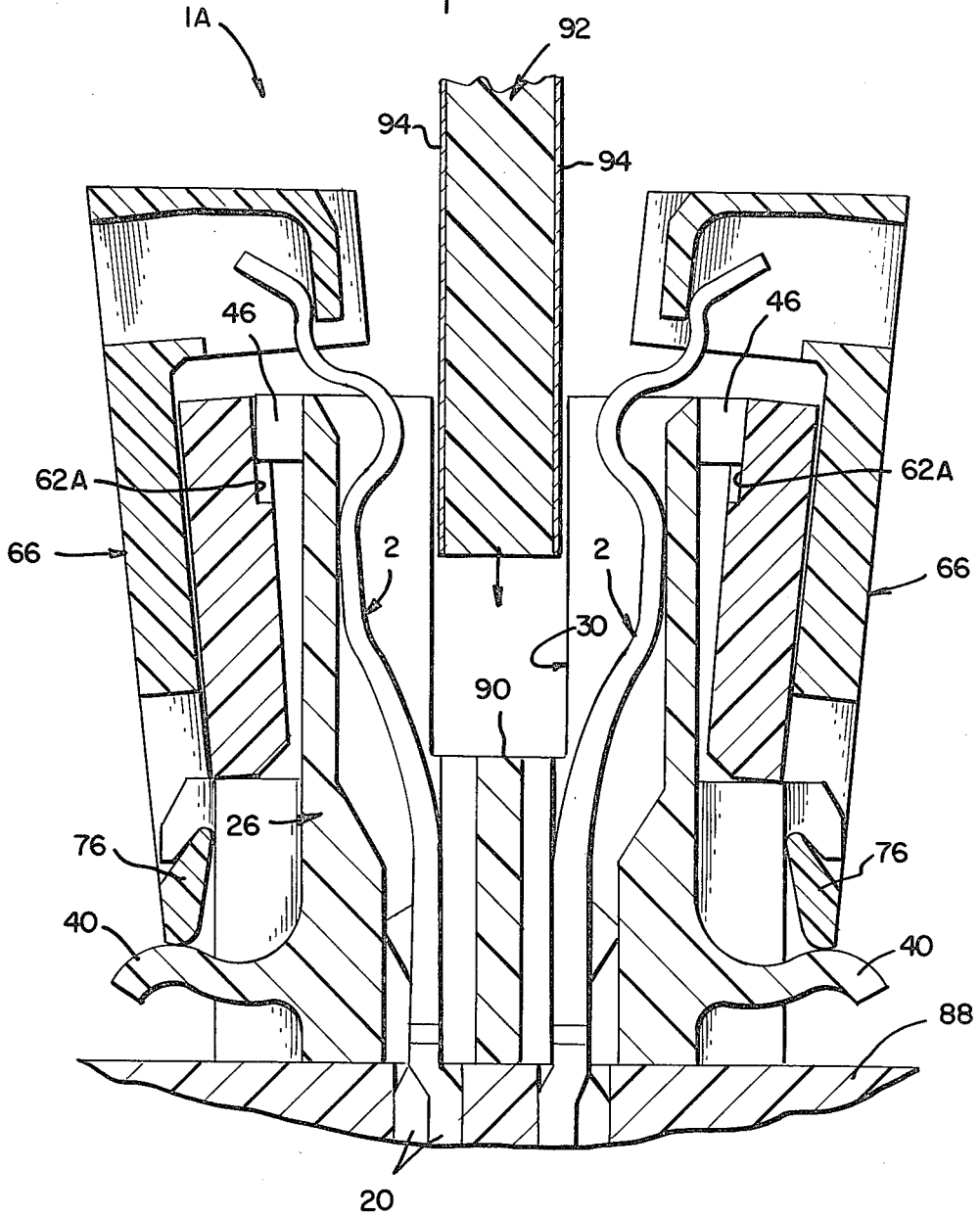
FIG. 7 is an enlarged transverse section of a connector shown in FIG. 1 modified to serve as a card edge ZIF connector.

FIG. 7 illustrates a modified connector 1A in which the central barrier wall 28 terminates inside the connector housing 26. The portion 90 of the wall 28 forms a bottom of a single receptacle opening 30 running the length of the connector housing 26. A planar circuit board 92 having plated circuit path conductors 94 thereon is insertable into the corresponding receptacle opening 30 until it registers against the bottom 90. Subsequently, the terminals 2 may deflect resiliently toward the wall 28 in a manner described in conjunction with FIG. 3, to frictionally engage the conductors 94. When using the multiple blades of the insertion tool, it is desirable to insert a shim block between the rows of blades to simulate the central barrier wall 28 which is absent from the connector 1A.

Although preferred embodiments of the present invention are disclosed in detail, other embodiments and modifications thereof which would become apparent to one having ordinary skill in the art are intended to be covered by the spirit and scope of the appended claims.

What is claimed is:

1. A preassembled electrical connector, comprising:

a rigid dielectric housing having one or more rows of cavities, a row of elongated leaf spring terminals lockingly retained in each said row of cavities, said housing provided with one or more receptacle openings into which circuit path conductors are pluggably inserted and into which the terminals project for frictional and electrical engagement with said conductors, fulcrum means on said housing, a dielectric shroud pivotally connected to said fulcrum means, means for pivoting said shroud about said fulcrum means, said shroud being hooked over a corresponding row of said terminals, and, upon pivoting about said fulcrum means, resiliently deflecting said terminals away from said one or more receptacle openings, permitting insertion of said conductors into said openings with reduced frictional engagement by said terminals, and resilient means on said housing for urging said shroud into pivotal engagement with said fulcrum means.

2. The structure as recited in claim 1, wherein said resilient means includes one or more fingers molded integral with said housing.

3. The structure as recited in claim 1, wherein said fulcrum means include one or more tabs, each of inverted hook configuration.

4. The structure as recited in claim 3, wherein said fingers resiliently engage and lift said shroud into pivotal engagement with said hook configuration tabs.

5. The structure as recited in claim 4, wherein said fingers curve over an inverted edge of said shroud, said shroud includes apertures defining lip portions at the peripheries of said apertures, and said tabs pass through said apertures and are hooked over said lip portions.

6. The structure as recited in claim 4, wherein said terminals resiliently engage and lift said shroud into pivotal engagement with said tabs.

7. The structure as recited in claim 1, wherein said terminals resiliently bias said shroud into pivotal engagement with said fulcrum means, and said resilient means resiliently engages and biases said shroud into pivotal engagement with said fulcrum means.

8. The structure as recited in claim 7, wherein said terminals and said resilient means continuously engage and resiliently bias said shroud into pivotal engagement with said fulcrum means.

9. The structure as recited in claim 1, wherein said means for pivoting said shroud include a blade member having a thickened section wedged between said shroud and said housing, pivoting said shroud about said fulcrum means and urging said shroud away from said housing.

10. The structure as recited in claim 1, wherein, each said terminal includes an arcuate part provided with a slot therein, one end of said slot having an end wall defining a tool rest.

11. The structure as recited in claim 1, wherein, each said terminal includes a slotted web portion defining a tool rest.

12. The structure as recited in claim 1, wherein, each said terminal includes an arcuate part extending toward a respective said receptacle opening and provided with a slot therein, one end of said slot defining a tool rest for a tool inserted along a respective said receptacle opening and in registration with said slot.

* * * * *